US007573323B2

(12) United States Patent
Moholt et al.

(10) Patent No.: US 7,573,323 B2
(45) Date of Patent: Aug. 11, 2009

(54) CURRENT MIRROR BIAS TRIMMING TECHNIQUE

(75) Inventors: Jørgen Moholt, Moss (NO); Per Olaf Pahr, Lier (NO); Tore Martinussen, Oslo (NO)

(73) Assignee: Aptina Imaging Corporation, Grand Cayman (KY)

( * ) Notice: Subject to any disclaimer, the term of this patent is extended or adjusted under 35 U.S.C. 154(b) by 4 days.

(21) Appl. No.: 11/756,272

(22) Filed: May 31, 2007

(65) Prior Publication Data

US 2008/0297234 A1 Dec. 4, 2008

(51) Int. Cl.
*G05F 3/02* (2006.01)
*G05F 1/10* (2006.01)

(52) U.S. Cl. ..... 327/538; 327/540; 327/541; 327/543

(58) Field of Classification Search ..... 327/538, 327/540, 541, 543
See application file for complete search history.

(56) References Cited

U.S. PATENT DOCUMENTS 5,867,001 A * 2/1999 Lagerquist et al. ..... 318/400.32
6,069,511 A * 5/2000 Mohan ..... 327/171
6,151,186 A * 11/2000 O'Farrell ..... 360/78.04
6,184,723 B1 2/2001 Frechette et al.
6,501,299 B2 12/2002 Kim et al.
6,605,979 B1 8/2003 Archer
6,690,228 B1 2/2004 Chen et al.
6,747,475 B2 * 6/2004 Yuffe et al. ..... 326/30
6,864,741 B2 3/2005 Marsh et al.
6,956,413 B2 * 10/2005 Bailey ..... 327/131

(Continued)

FOREIGN PATENT DOCUMENTS

GB 2336960 3/1999
WO WO 90/15378 A1 12/1990

OTHER PUBLICATIONS

Green, et al.; A Novel mA Level PTAT Current Generator Technique; Circuits and Systems, 2006 IEEE North-East Workshop; Jun. 2006; pp. 221-224; School of Technology, Oxford Brookes University, Oxford, UK; posted online Nov. 30, 2006: http://ieeexplore.ieee.org/xpl/freeabs_all.jsp?isnumber=4016923&arnumber=4016977&count=86&index=53.

*Primary Examiner*—Lincoln Donovan
*Assistant Examiner*—Adam D Houston
(74) *Attorney, Agent, or Firm*—Kramer Levin Naftalis & Frankel LLP

(57) ABSTRACT

A reference current is generated by a current mirror circuit. An operational amplifier of a feedback circuit generates a control voltage for control of the feedback circuit transistor. The size of the feedback circuit transistor is trimmed, and the current through the feedback circuit transistor remains relatively constant via operation of the feedback circuit. The feedback circuit transistor is scaled in size relative to the size of current reference transistor(s) (e.g., current sources or sinks), which are tied to the same control voltage. The reference current of the current reference transistors thus varies with the size of the feedback circuit transistor. Further advantageously, transistors providing reference currents for resistor ladders can also be tied to the same control voltage, but scaled proportionally with changes in size to the feedback circuit transistor, thereby maintaining relatively constant voltage from taps of the resistor ladder, even when the feedback circuit transistor is trimmed.

32 Claims, 5 Drawing Sheets

U.S. PATENT DOCUMENTS 7,019,581 B1 * 3/2006 Potanin et al. ..... 327/427
7,119,527 B2 10/2006 Fernald
7,142,044 B2 * 11/2006 Sano ..... 327/540
7,167,041 B2 * 1/2007 Khalid ..... 327/541
7,193,454 B1 * 3/2007 Marinca ..... 327/539
7,208,998 B2 * 4/2007 Abel ..... 327/538
7,215,180 B2 * 5/2007 Nagata et al. ..... 327/538
7,218,168 B1 * 5/2007 Rahman ..... 327/540
7,265,608 B1 * 9/2007 Lu et al. ..... 327/543
7,271,755 B2 * 9/2007 Mulder et al. ..... 341/154
2005/0068092 A1 * 3/2005 Sano ..... 327/541
2006/0103453 A1 * 5/2006 Pisasale et al. ..... 327/541
2006/0132223 A1 * 6/2006 Cherek ..... 327/538
2006/0202738 A1 * 9/2006 Gatta et al. ..... 327/427
2006/0226893 A1 * 10/2006 Abel ..... 327/543
2006/0238235 A1 * 10/2006 Wey et al. ..... 327/543
2006/0267110 A1 * 11/2006 Chen ..... 257/401
2007/0052472 A1 * 3/2007 Lin et al. ..... 327/538
2007/0103227 A1 * 5/2007 Khalid ..... 327/541
2007/0115045 A1 * 5/2007 Nagata et al. ..... 327/540

* cited by examiner

CURRENT MIRROR BIAS TRIMMING TECHNIQUE

BACKGROUND

1. Field of the Invention

One embodiment of the invention generally relates to fabrication of analog integrated circuit. In particular, one embodiment the invention relates to trimming of analog current references, which is typically performed during test of an integrated circuit.

2. Description of the Related Art

Unlike digital circuits, analog circuits frequently use adjustment or trimming procedures. One such analog circuit is a current reference. Current references are frequently used in analog integrated circuits. These current references can be either current sources or current sinks. In practice, current references can be relatively difficult to implement. For example, a current reference should be of relatively high precision when used as a reference for a digital-to-analog converter (DAC). Otherwise, the analog output of the DAC can become degraded.

In one conventional current reference, the reference current is generated by mirroring an initial reference current. Due to the relatively large variability from die to die of resistors, the initial reference current is trimmed by trimming the resistors. However, these resistor trims can affect other biases, thus requiring further trimming in mirroring references. These other trimming operations can require additional components, such as trimming DACs and extra mirrors for each current reference. The additional circuits can increase die area, cost, and power consumption. In addition, the additional trimming procedures, often requiring trimming of each current reference, can be relatively time consuming, which adds to production test time and cost. The additional expense becomes particularly acute when relatively many current references are present. For example, it is not uncommon to have 32 current references on an integrated circuit for references or biasing of other circuits.

BRIEF DESCRIPTION OF THE DRAWINGS

These drawings and the associated description herein are provided to illustrate specific embodiments of the invention and are not intended to be limiting.

DETAILED DESCRIPTION OF SPECIFIC EMBODIMENTS

In one embodiment, a reference current is generated by a current mirror circuit. A feedback circuit is used to generate a reference gate voltage. The current ("feedback current") passing through a feedback circuit transistor is held constant by operation of a feedback loop. In one embodiment, the feedback circuit uses an operational amplifier to generate a control voltage for control of the feedback circuit transistor. Rather than trimming a resistor to trim feedback the current passing through the feedback circuit transistor, the size of the feedback circuit transistor is trimmed, and the feedback current remains relatively constant. While the feedback current remains constant, the control voltage for the gate of the feedback circuit transistor varies with the change in area; this control voltage is applied to current reference transistors to vary their currents. Advantageously, relatively fewer trimming operations can be used, which can reduce test time and reduce associated costs with adjusting reference currents.

Another advantage of the technique is that other mirrored currents which are desirably relatively constant (not adjusted) are efficiently provided. For example, a way to generate voltage references is by passing a relatively constant current through a resistor ladder. This current is preferably maintained constant and does not change when the adjustable reference currents are trimmed. Because the trimming of the feedback current is performed by adjusting a transistor size, proportional adjustments to transistor size can be implemented for those transistors providing currents for voltage references, and relatively little, if any, further trimming is needed. In one embodiment, no further trimming is necessary. This can speed up production and save cost.

Although particular embodiments are described herein, other embodiments of the invention, including embodiments that do not provide all of the benefits and features set forth herein, will be apparent to those of ordinary skill in the art. In addition, while illustrated in the context of current sources implemented with PMOS transistors, the principles and advantages described herein are also applicable to current sinks implemented with NMOS transistors.

Figure 1A:
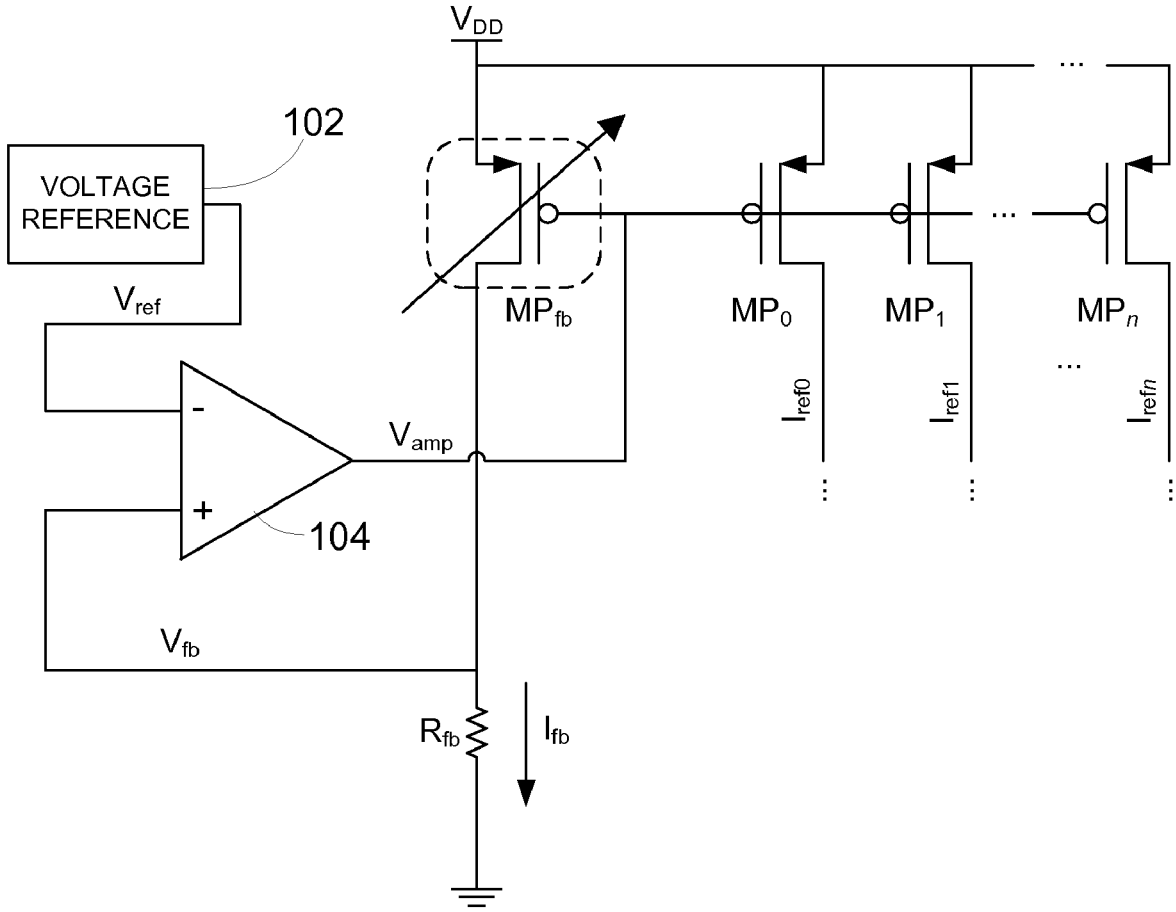
FIG. 1A is a schematic generally illustrating an embodiment of the invention in which one or more current references are trimmed by adjusting the size of a feedback circuit transistor.

FIG. 1A is a schematic generally illustrating an embodiment of the invention in which one or more current references are trimmed by adjusting the size of a feedback circuit transistor. As will be described later in connection with FIG. 3, the concept can be extended to include the generation of voltage references.

In the illustrated embodiment of FIG. 1A, the various components shown are integrated on an integrated circuit. Accordingly, devices such as transistors can be expected to be relatively well matched. The circuit includes a voltage reference 102, an operational amplifier 104, a feedback circuit resistor $R_{fb}$, a feedback circuit transistor $MP_{fb}$, and one or more reference current transistors $MP_0$, $MP_1$, . . . $MP_n$. The feedback circuit transistor $MP_{fb}$ and the reference current transistors $MP_0$, $MP_1$, . . . $MP_n$ should be of the same type, e.g., PMOS in the illustrated embodiment. The dashed box and arrow around the feedback circuit transistor $MP_{fb}$ indicate that its area or width-to-length ratio (W/L) is adjusted as will be described in further detail later in connection with trimming of the feedback circuit transistor $MP_{fb}$ (see FIG. 1B and attendant description). In the illustrated embodiment, a positive voltage reference $V_{DD}$ indicators power supply voltage. In the illustrated embodiment, the source terminals of the illustrated transistors $MP_{fb}$, $MP_0$, $MP_1$, . . . $MP_n$ are tied to $V_{DD}$, and the gate terminal of the illustrated $MP_{fb}$, $MP_0$, $MP_1$, . . . $MP_n$ are tied to a control voltage $V_{amp}$ output of the operational amplifier 104. In the illustrated embodiment, a drain of the feedback circuit transistor $MP_{fb}$ is coupled to a non-inverting input of the operational amplifier 104 and to a terminal of the feedback circuit resistor $R_{fb}$. Drain terminals of current reference transistors are coupled to their respective circuits, e.g., current reference inputs of DACs.

The operation of the feedback circuit or loop will be described first. The voltage reference 102 provides a reference voltage $V_{ref}$ to an inverting input of the operational amplifier 104. The voltage reference 102 can be, for example, a band-gap voltage reference. The reference voltage $V_{ref}$ is constant.

An output of the operational amplifier is a control voltage $V_{amp}$ and is coupled to a gate of the feedback circuit transistor $MP_{fb}$. As will be explained in greater detail below, the control voltage $V_{amp}$ applied to the gate of the feedback circuit transistor $MP_{fb}$ is also applied to the current reference transistors $MP_0$, $MP_1$, . . . $MP_n$ for control. The control voltage $V_{amp}$ controls the gate voltage of the feedback circuit transistor $MP_{fb}$ and thereby controls a drain current from the drain terminal of the feedback circuit transistor $MP_{fb}$. The drain current is represented in the schematic as a feedback circuit current $I_{fb}$ flowing through the feedback circuit resistor $R_{fb}$. Leakage current flowing into or out of the positive input of the operational amplifier 104 is negligible and can be ignored.

The feedback circuit current $I_{fb}$ establishes a feedback voltage $V_{fb}$ generated by the voltage drop across the feedback circuit resistor $R_{fb}$. This feedback voltage $V_{fb}$ is applied to the positive input of the operational amplifier 104. It should be noted that there is phase inversion from the gate to the drain of the feedback circuit transistor $MP_{fb}$ so that the inputs of the operational amplifier 104 are effectively inverted. When the feedback loop is closed, the operational amplifier 104 maintains an output voltage $V_{amp}$ such that the feedback voltage $V_{fb}$ is about equal to the reference voltage $V_{ref}$. Accordingly, the feedback circuit current $I_{fb}$ flowing through feedback circuit transistor $MP_{fb}$ is also constant. Thus, a constant current feedback control circuit or loop is formed by the voltage reference 102, operational amplifier 104, resistant $V_{amp}$ and feedback $V_{fb}$ generated by $I_{fb}$ and $R_{fb}$.

While the feedback circuit current $I_{fb}$ is constant in a given die when the feedback loop is closed, the particular amount of the feedback circuit current $I_{fb}$ can vary significantly from die to die because, for example, the feedback circuit resistor $R_{fb}$ can vary from die to die. Typically, with state of the art processing, resistors implemented in integrated circuits exhibit die to die variability of about 20%. Because the current reference transistors $MP_0$, $MP_1$, . . . $MP_n$ are mirrored from the feedback circuit transistor $MP_{fb}$, the reference currents $I_{ref0}$, $I_{ref1}$, . . . $I_{refn}$ of the current reference transistors $MP_0$, $MP_1$, . . . $MP_n$ also vary from die to die and are trimmed as described in the following. Rather than trim the feedback circuit current $I_{fb}$ by trimming the feedback circuit resistor $R_{fb}$, the feedback circuit transistor $MP_{fb}$ is trimmed.

When the feedback circuit transistor $MP_{fb}$ is trimmed, the operation of the feedback loop continues to maintain the feedback current constant $I_{fb}$ by appropriate control of the gate voltage $V_{amp}$ applied to the feedback circuit transistor $MP_{fb}$. However, the control voltage $V_{amp}$ also controls the current reference transistors $MP_0$, $MP_1$, . . . $MP_n$ and the change in the control voltage $V_{amp}$ acts to trim the reference currents $I_{ref0}$, $I_{ref1}$, . . . $I_{refn}$. Accordingly, scaling the width-to-length ratio (W/L) of the feedback circuit transistor $MP_{fb}$ relative to the width-to length ratio (W/L) of a circuit reference transistor $MP_0$ also scales the relative circuit, i.e., $I_{fb}$ versus $I_{ref0}$. In one embodiment, to a first-order approximation, the scaling of current is about linear with the scaling of relative width-to-length (W/L) ratios. However, as will be described later in connection with FIG. 3, if another transistor, such as the voltage reference transistor $MP_{v1}$ is scaled proportionally with the trimming of the feedback circuit transistor $MP_{fb}$, then the current of the proportionally-scaled transistor remains constant.

Figure 1B:
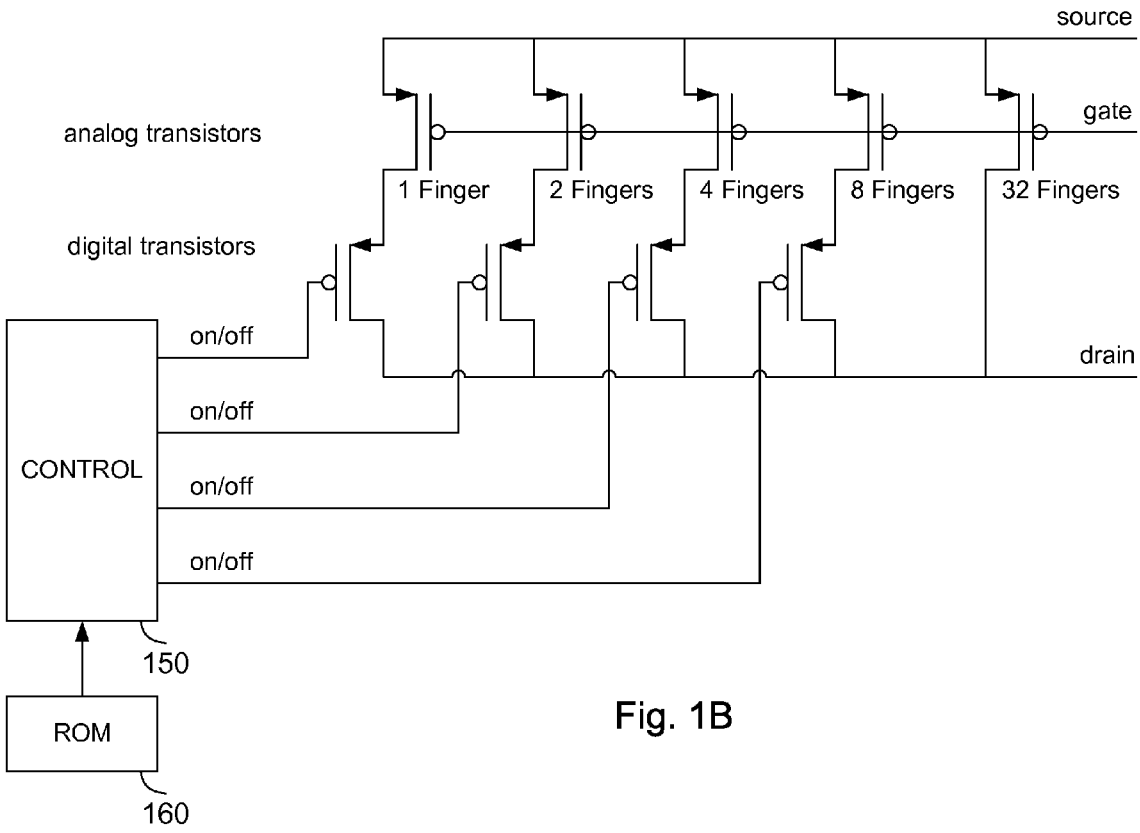
FIG. 1B illustrates an adjustable or trimmable transistor having multiple fingers.

The trimming of the feedback circuit transistor $MP_{fb}$ can be accomplished in a variety of ways. In one embodiment illustrated in FIG. 1B, a transistor of the integrated circuit is formed with multiple fingers as schematically illustrated in FIG. 1B. For example, in one embodiment, all of the fingers are of the same size, though it will be appreciated that varying sizes can be used. Typically, each finger has the same length (L) as the transistor, and the overall width of the activated fingers determines the overall width (L) of the transistor. In the illustrated embodiment, analog transistors of 1, 2, 4, 8 and 32 fingers are illustrated with sources coupled to a common "source" terminal, and with gates coupled to a common "gate" terminal. In the illustrated embodiment, the drain of the 32 fingers are coupled directly to the drain terminal" such that these 32 fingers are active without programming intervention. The 1 finger, 2 finger, 4 finger, and 8 finger groups have drains tied to corresponding digital transistors, which are controlled on or off by a control 150. A read only memory (ROM) 160, which can be programmed during production test, stores the information for the control. The control and ROM can be relatively simple, such as implemented with anti-fuses. Multiple fingers are similar to having many relatively small transistors in parallel. The use of multiple small fingers is preferred rather than a large transistor because it assists in a layout for efficient utilization of chip area. A multiple-finger transistor is still referred to as a transistor. In addition, it should be noted that the fingers can be the same size or varying sizes, and that the various groupings of fingers do not need to be in groups of powers of two. For example, in another embodiment, individual fingers can be individually controlled for scaling of width-to-length (W/L) ratio.

The number of fingers activated for the feedback circuit transistor $MP_{fb}$ effectively determines the width-to-length ratio of the feedback circuit transistor $MP_{fb}$. Additional switches (transistors) can be placed in series with at least some of the fingers to provide adjustment of the number of fingers selected. The selected configuration can be stored in ROM. Typically, these switches are placed in series with the drains of the fingers. For example, the fingers for adjustment can be arranged in groups of 1, 2, 4, and 8 effective fingers of equal size (though in other arrangements they can vary in size) as illustrated in FIG. 1B, each group independently controlled by a switch. For example, if 15 suitable fingers are combined with 32 fingers that are not switched, then the number of fingers can vary from 32 to 47 fingers or about plus or minus 21% from about 39 fingers. Alternatively, the 32 non-switchable fingers can be replaced with a single transistor structure or multiple transistor structure with fewer than 32 fingers but of effectively 32 finger's size producing the desired current output. This permits the width-to-length ratio (W/L) of the feedback circuit transistor $MP_{fb}$ to be scalable relative to reference transistors $MP_0$, $MP_1$, . . . $MP_n$ to trim the reference currents $I_{ref0}$, $I_{ref1}$, . . . $I_{refn}$ of the current reference transistors $MP_0$, $MP_1$, . . . $MP_n$.

Figure 2:
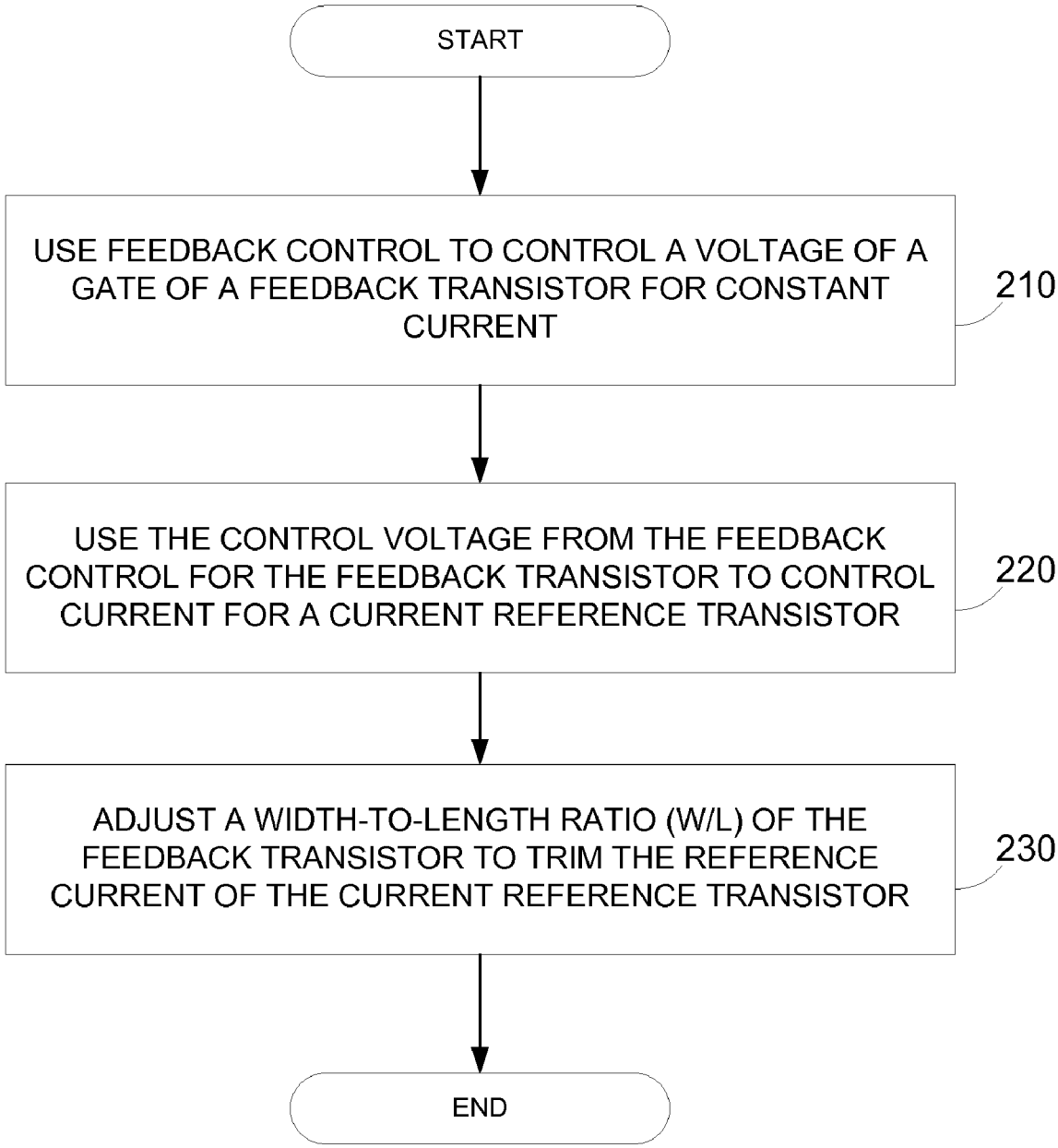
FIG. 2 is a flowchart generally illustrating a process for trimming a current reference.

FIG. 2 is a flowchart, generally illustrating a process for trimming a current reference. For example, the current reference can be $I_{ref0}$ (FIG. 1). The number of current references can vary in a broad range. Advantageously, all of the current references $I_{ref0}$, $I_{ref1}$, . . . $I_{refn}$ can be trimmed at the same time simply by trimming the feedback circuit transistor $MP_{fb}$ (FIG. 1). This saves expensive test time and reduces unit cost.

It will be appreciated by the skilled practitioner that the illustrated process can be modified in a variety of ways. For example, in another embodiment, various portions of the illustrated process can be combined, can be rearranged in an alternate sequence, can be removed, and the like.

The process begins by using feedback control 210 to control a voltage of a gate of a feedback circuit transistor for constant current. For example, with reference to FIG. 1, the voltage reference 102, the operational amplifier 104, the feedback circuit resistor $R_{fb}$ and the feedback circuit transistor $MP_{fb}$ operate to provide the control voltage $V_{amp}$ to the gate of the feedback circuit transistor $MP_{fb}$.

The process advances to use the control voltage 220 from the feedback control for the feedback circuit transistor to control current for a current reference transistor. The control voltage can be the control voltage $V_{amp}$ (FIG. 1A). For example, current from one or more current reference transistors $MP_0$, $MP_1$, . . . $MP_n$ can be controlled. In one embodiment, the reference currents $I_{ref0}$, $I_{ref1}$, . . . $I_{refn}$ are aggregated and a current is measured, and the feedback circuit transistor $MP_{fb}$ is trimmed. The aggregation can be accommodated by switching the reference currents to a node, and externally accessing the node for measurement of the aggregated current by a current monitoring circuit.

Figure 3:
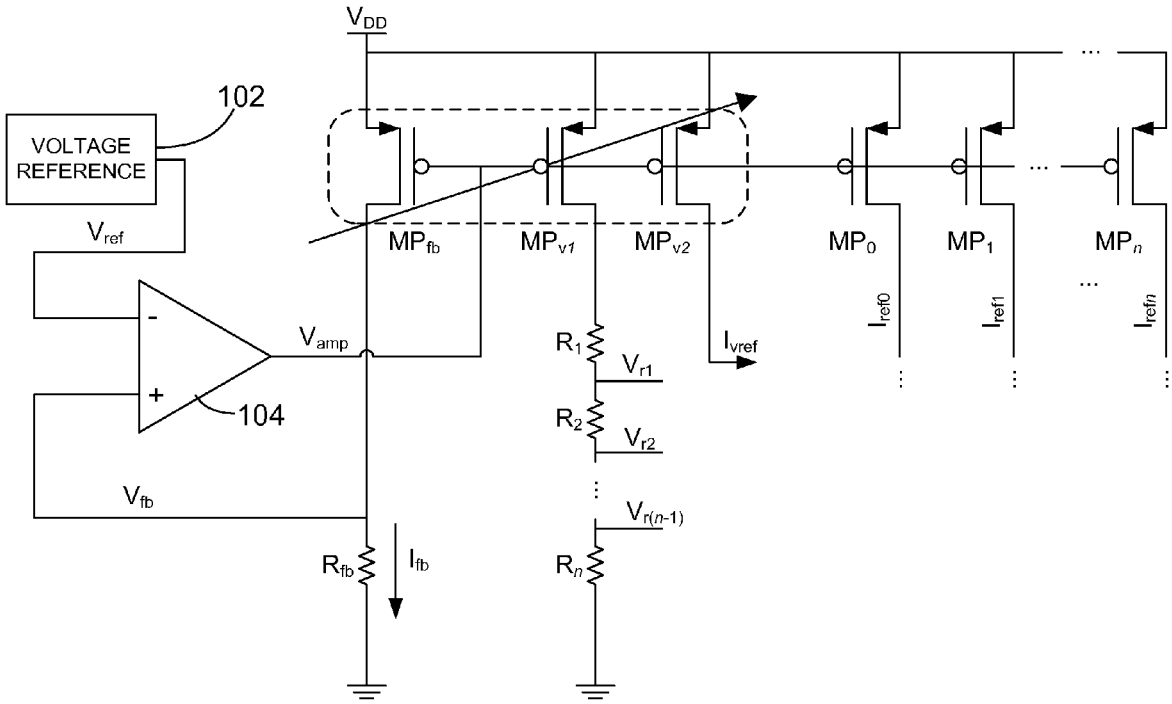
FIG. 3 is a schematic generally illustrating another embodiment of the invention wherein in addition to current references, voltage references are also generated.

The process advances to adjust a width-to-length ratio (W/L) 230 of the feedback circuit transistor to trim the reference current of the current reference transistor. An advantage of the process is that outputs of multiple current reference transistors can be trimmed with only a trim to a feedback circuit transistor. Another advantage, to be described in connection with FIG. 3, is that the trimming of the current references can be performed without deleteriously affecting voltage references, further saving test time. For example, the number of fingers of a transistor activated for trimming of the transistor can be permanently set by storing the appropriate control in a ROM.

FIG. 3 is a schematic generally illustrating another embodiment of the invention wherein in addition to current references, voltage references are also generated. The feedback components and the current reference components can be as described earlier in connection with FIG. 1A.

The voltage references $V_{r1}$, $V_{r2}$, . . . $V_{r(n-1)}$ are generated by passing current through a resistor ladder $R_1$, $R_2$, . . . $R_n$, and accessing voltage from the taps or nodes between resistors. In the illustrated embodiment, two voltage reference transistors $MP_{v1}$, $MP_{v2}$ are shown. However, the number can vary in a very broad range and can be one or more. The voltage reference transistors $MP_{v1}$, $MP_{v2}$ should be of the same type, i.e., PMOS or NMOS, as the feedback circuit transistor $MP_{fb}$.

As indicated by the dashed box and the arrow, the width-to-length ratios (W/L) are trimmed for the feedback circuit transistor $MP_{fb}$, the first voltage reference transistor $MP_{v1}$ and the second voltage reference transistor $MP_{v2}$. The gates of first voltage reference transistor $MP_{v1}$ and the second voltage reference transistor $MP_{v2}$ are also coupled to the same control voltage as the gate of the feedback circuit transistor, and the sources of the transistors are all tied to the same potential ($V_{DD}$). Drains of the first voltage reference transistor $MP_{v1}$, and the second voltage reference transistor $MP_{v2}$ are coupled to resistor ladders. The trimming techniques described earlier in connection with FIG. 1A can also be used. In addition, it should be noted that, typically, the feedback circuit transistor $MP_{fb}$ is smaller than the other transistors. In one embodiment, the "size" of the transistors varies by the number of fingers, as described above for multi-finger transistors.

The resistor ladder $R_1$, $R_2$, . . . $R_n$ is part of the same integrated circuit as the feedback circuit resistor $R_{fb}$. A second resistor ladder for a current reference $I_{vref}$ for the voltage reference transistor $MP_{v2}$ is not shown. While the resistors of the resistor ladder $R_1$, $R_2$, . . . $R_n$ and the feedback circuit resistor $R_{fb}$ typically vary considerably from die to die, they are on the same die and vary proportionally. Accordingly, the values of the resistances tend to track each other, and relatively little, if any, trimming of the resistor ladder $R_1$, $R_2$, . . . $R_n$ is needed. In one embodiment, only a single resistor of the resistor ladder $R_1$, $R_2$, . . . $R_n$ is trimmed. Preferably, the trimmed resistor is the top-most resistor $R_1$. In one embodiment, the resistor ladder $R_1$, $R_2$, . . . $R_n$ is trimmed before any of the transistors are trimmed. For example, in one embodiment, a resistor is trimmed by a resistor trimming apparatus, such as a laser trimmer.

The trimming of the feedback circuit transistor $MP_{fb}$ affects the control voltage applied to the transistors $MP_{fb}$, $MP_{v1}$, $MP_{v2}$. However, provided that the voltage reference transistors $MP_{v1}$, $MP_{v2}$ are also trimmed in size proportionally with the trimming of the feedback circuit transistor $MP_{fb}$, the current provided by each of voltage reference transistor $MP_{v1}$ and voltage reference transistor $MP_{v2}$ for their respective resistor ladders should remain about the same. For example, in one embodiment, the fingers of transistors of an integrated circuit have the same length (L), and the inclusion or exclusion of various fingers changes the width (W) of the transistor. In one embodiment, this is accomplished by selectively activating fingers for the particular transistor. A preferred scaling between the feedback circuit transistor $MP_{fb}$ and a voltage reference transistor $MP_{v1}$ should be known due to the designed values of the feedback circuit resistance $R_{fb}$ and the voltage ladder $R_1$, $R_2$ . . . $R_n$, which vary from die-to-die, but vary together on the same die. Accordingly, the predetermined relationship in width-to-length (W/L) ratios (ratio of ratios) should exist before trimming for the feedback circuit transistor $MP_{fb}$ and the voltage reference transistor $MP_{v1}$. After trimming, this ratio of width-to-length ratios (W/L) should be preserved such that the reference currents passing through the voltage reference ladders remains relatively constant. Advantageously, the voltage reference transistors do not need to be re-trimmed after the trimming of the current reference transistors $MP_0$, $MP_1$, . . . $MP_n$.

Figure 4:
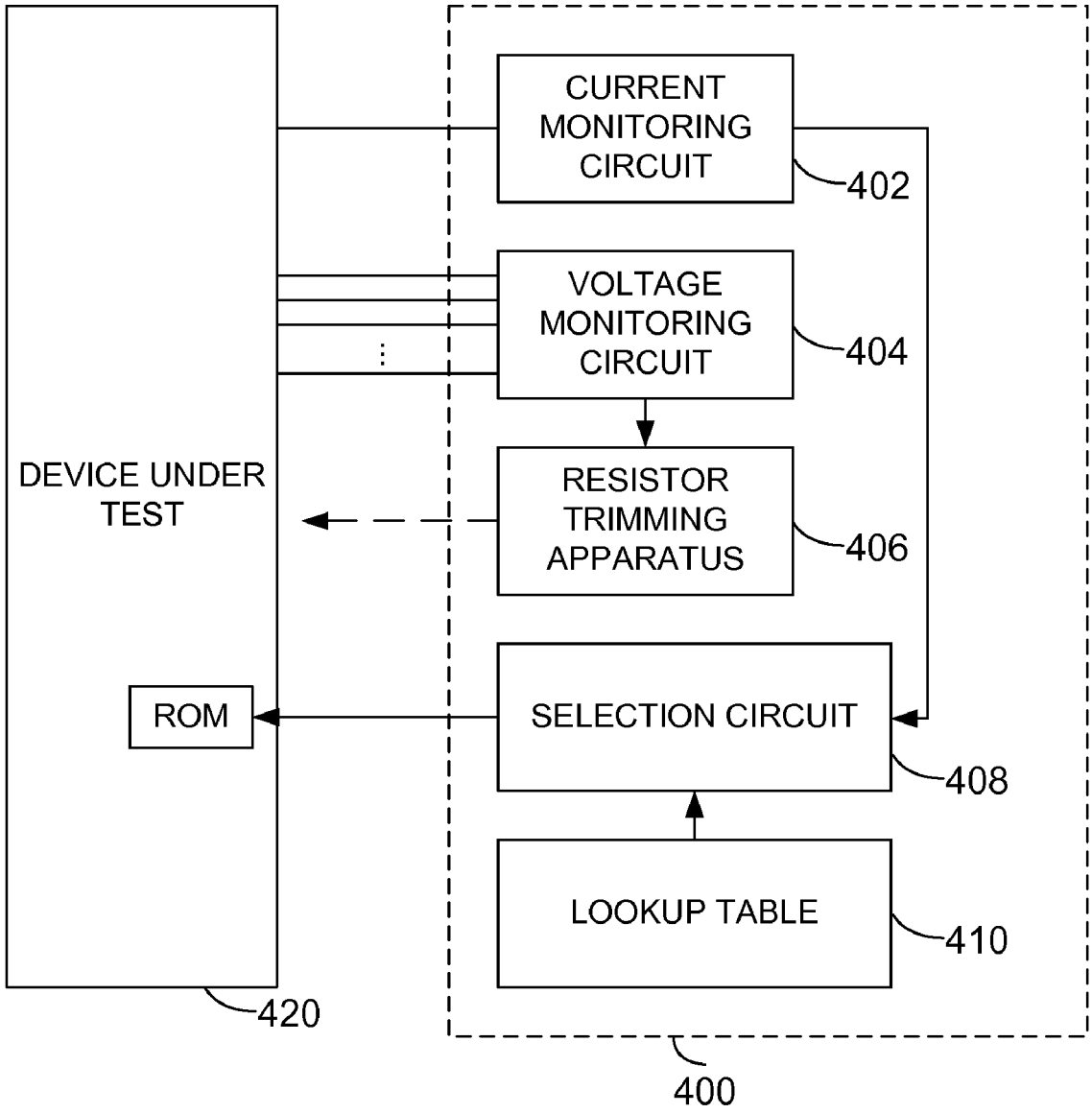
FIG. 4 illustrates an example of a testing apparatus for trimming a current reference and/or a voltage reference.

FIG. 4 illustrates a test apparatus 400 for trimming a current reference and/or voltage reference. The current reference and/or voltage reference are part of an integrated circuit labeled device under test (DUT) 420, which includes a ROM for storage of transistor sizing information.

The illustrated test apparatus 400 includes a current monitoring circuit 402, a voltage monitoring circuit 404, a resistor trimming apparatus 406, a selection circuit 408, and a lookup table 410. The current monitoring circuit 402 can be used to measure the current from a current reference, such as a current source. In one embodiment, the currents from multiple current references are aggregated for measurement, and the measurement is compensated for the aggregation. In one embodiment, the measurement of the current is provided as an input to the selection circuit 408, which can, for example, program a ROM of the DUT 420 to permanently configure selected which fingers of a transistor are activated. A lookup table 410 can provide reference information, such as provide a predetermined map of the number of transistors to activate given an initial measurement from the current monitoring circuit 402. Of course, the determination of how many fingers to activate can also be made iteratively.

A voltage monitoring circuit 404 measures the voltage references, such as references $V_{r1}$, $V_{r2}$, . . . $V_{r(n-1)}$ from a resistor ladder $R_1$, $R_2$, . . . , $R_n$ (FIG. 3). A resistor trimming apparatus 406, such as a laser trimmer, trims the resistor ladder $R_1$, $R_2$, . . . , $R_n$. In one embodiment, only the top-most resistor $R_1$ is trimmed. In one embodiment, the trimming of the voltage references is performed before the trimming of the current, taking advantage that the current references can be trimmed without affecting the trim of the voltage references.

One embodiment is a method of trimming a current reference transistor providing a reference current for an integrated circuit, wherein the method includes: using feedback control to generate a control voltage for a gate of a feedback circuit transistor of the integrated circuit such that current passing through the feedback circuit transistor is substantially constant; using the control voltage for the gate of the feedback circuit transistor to control a gate of the current reference transistor of the integrated circuit, wherein a source of the feedback circuit transistor and a source of the current reference transistor are tied to a same voltage potential; and adjusting a width-to-length ratio (W/L) of the feedback circuit transistor to trim the reference current flowing through the current reference transistor.

One embodiment is an integrated circuit including: a current reference transistor having a gate, a source, and a drain; a feedback circuit transistor having a gate, a source, and a drain, wherein the gate of the feedback circuit transistor is operatively coupled to the gate of the current reference transistor, wherein the source of the feedback circuit transistor is operatively coupled to the source of the current reference transistor, wherein a number of activated fingers of the feedback circuit transistor is selectable such that a width-to-length ratio (W/L) of the feedback circuit transistor is scalable; and a feedback circuit configured to generate a control voltage for the gate of the feedback circuit transistor, wherein the feedback circuit is configured to maintain a substantially constant current through the feedback circuit transistor.

One embodiment is an apparatus for trimming an integrated circuit, wherein the apparatus includes: a current monitoring circuit configured to monitor a current of a first transistor of the integrated circuit; and a selection circuit configured to select a number of fingers of a second transistor to adjust a current flowing through the first transistor.

One embodiment is a method of configuring a current reference of an integrated circuit, wherein the method includes: monitoring a current of a first transistor of the integrated circuit; and selecting a number of fingers of a second transistor to adjust a current flowing through the first transistor.

Various embodiments have been described above. Although described with reference to these specific embodiments, the descriptions are intended to be illustrative and are not intended to be limiting. Various modifications and applications may occur to those skilled in the art without departing from the true spirit and scope of the invention as defined in the appended claims.

We claim:

1. A method of trimming a current reference transistor providing a reference current for an integrated circuit, the method comprising:

using feedback control to generate a control voltage for a gate of a feedback circuit transistor of the integrated circuit such that current passing through the feedback circuit transistor is substantially constant;

using the control voltage for the gate of the feedback circuit transistor to control a gate of the current reference transistor of the integrated circuit, wherein a source of the feedback circuit transistor and a source of the current reference transistor are tied to a same voltage potential;

monitoring the reference current flowing through the current reference transistor; and in response to the monitored reference current, adjusting a width-to-length ratio (W/L) of the feedback circuit transistor to trim the reference current flowing through the current reference transistor while maintaining constant the current passing through the feedback circuit transistor.

2. The method of claim 1, further comprising determining the current of the current reference transistor and adjusting the width-to-length ratio (W/L) of the feedback circuit transistor at least partially in response to the determined current.

3. The method of claim 1, wherein adjusting further comprises adjusting to trim the reference current flowing through the current reference transistor relative to the current passing through the feedback circuit transistor.

4. The method of claim 1, further comprising controlling current for a plurality of current reference transistors, wherein gates of each of the plurality of current reference transistors shares are operatively coupled to the same voltage as the gate of the feedback circuit transistor, and wherein sources of each of the plurality of current reference transistors are operatively coupled to the source of the feedback circuit transistor.

5. The method of claim 1, wherein using the control voltage comprises the feedback circuit transistor and the at least one current reference transistor are PMOS.

6. The method of claim 1, wherein the feedback circuit transistor and the at least one current reference transistor are NMOS.

7. The method of claim 1, wherein using feedback control comprises further comprising using an operational amplifier for the feedback control.

8. The method of claim 1, wherein using feedback control comprises:

providing the current passing through the feedback circuit transistor to a feedback circuit resistor, wherein the feedback circuit resistor is integrated into the integrated circuit;

providing a voltage generated by the current passing through the feedback circuit resistor as a feedback signal for a first input to an operational amplifier of the integrated circuit;

providing a voltage reference as a second input to the operational amplifier; and coupling an output of the operational amplifier to the gate of the feedback circuit transistor for control of the gate voltage.

9. The method of claim 8, further comprising adjusting to trim the reference current flowing through the current reference transistor relative to the current passing through the feedback circuit transistor.

10. The method of claim 1, further comprising operatively coupling the current reference to a current reference input of a digital-to-analog converter, wherein the digital-to-analog converter is integrated in the integrated circuit.

11. The method of claim 1, wherein adjusting the width-to-length ratio (W/L) comprises selectively activating multiple fingers of the feedback circuit transistor.

12. The method of claim 11, wherein adjusting the width-to-length ratio (W/L) is performed during production test, and permanently setting the adjustment into the integrated circuit.

13. The method of claim 1, further comprising:

controlling current for a voltage reference transistor, wherein the voltage reference transistor is integrated with the integrated circuit;

adjusting a width-to-length ratio (W/L) of the voltage reference transistor proportionally with the width-to-length ratio (W/L) of the feedback circuit transistor;

providing the current passing through the voltage reference transistor to a resistor ladder, wherein the resistor ladder is integrated with the integrated circuit; and using one or more taps of the resistor ladder as voltage references.

14. The method of claim 13, wherein adjusting the width-to-length ratio (W/L) of the feedback circuit transistor and the voltage reference transistor comprises selectively activating multiple fingers of the feedback and voltage reference transistors such that a scale between the transistors remains approximately the same.

15. The method of claim 13, further comprising trimming a resistor of the resistor ladder to adjust the voltage references.

16. An integrated circuit comprising:

a current reference transistor having a gate, a source, and a drain;

a feedback circuit transistor having a gate, a source, and a drain, wherein the gate of the feedback circuit transistor is operatively coupled to the gate of the current reference transistor, wherein the source of the feedback circuit transistor is operatively coupled to the source of the current reference transistor, wherein a number of activated fingers of the feedback circuit transistor is selectable such that a width-to-length ratio (W/L) of the feedback circuit transistor is scalable with respect to the current reference transistor; and a feedback circuit configured to generate a control voltage for the gate of the feedback circuit transistor and the gate of the current reference transistor, wherein the feedback circuit is configured to maintain a substantially constant current through the feedback circuit transistor regardless of the number of activated fingers of the feedback circuit transistor, wherein the number of activated fingers is selected to achieve a desired amount of current flowing through the current reference transistor.

17. The integrated circuit of claim 16, wherein the feedback circuit comprises:

an operational amplifier; and a feedback circuit resistor with a terminal operatively coupled to a drain of the feedback circuit transistor and to a first input of the operational amplifier.

18. The integrated circuit of claim 17, wherein the feedback circuit comprises a voltage reference operatively coupled to a second input of the operational amplifier.

19. The integrated circuit of claim 16, wherein the feedback circuit transistor is scalable relative to the current reference transistor.

20. The integrated circuit of claim 16, further comprising a digital to analog converter operatively coupled to the current reference transistor.

21. The integrated circuit of claim 16, further comprising:

a voltage reference transistor having a gate, a source, and a drain, wherein the gate of the voltage reference transistor is operatively coupled to the gate of the feedback circuit transistor, wherein the source of the voltage reference transistor is operatively coupled to the source of the feedback circuit transistor, wherein a number of activated fingers of the voltage reference transistor is selectable and configured during test such that a width-to-length ratio (W/L) of the voltage reference transistor is scaled proportionally with the width-to-length ratio (W/L) of the feedback circuit transistor; and a resistor ladder operatively coupled to a drain of the voltage reference transistor, wherein a tap of the resistor ladder provides a voltage reference.

22. The integrated circuit of claim 21, wherein the feedback circuit transistor is scalable relative to the current reference transistor.

23. The integrated circuit of claim 16, wherein the current reference transistor and the feedback circuit transistor comprise PMOS.

24. The integrated circuit of claim 16, wherein the current reference transistor and the feedback circuit transistor comprise NMOS.

25. An apparatus for trimming an integrated circuit, the apparatus comprising:

a current monitoring circuit configured to monitor a current of a first transistor of the integrated circuit; and a selection circuit configured to select a number of fingers of a second transistor to modify a current flowing through the first transistor, the current flowing through the second transistor remains constant even when the selection circuit changes the number of fingers selected.

26. The apparatus of claim 25, wherein the current monitoring circuit is configured to aggregate current from a plurality of current reference transistors of the integrated circuit.

27. The apparatus of claim 25, wherein the selection circuit is further configured to permanently select the number of fingers for the integrated circuit.

28. The apparatus of claim 25, further comprising a resistor trimming apparatus configured to trim a resistor of a resistor ladder, wherein the resistor ladder provides one or more voltage references, wherein a current flowing through the resistor ladder from a third transistor partially determines the voltage of the voltage references, and wherein the selection circuit is configured to select a number of fingers of the third transistor such that a width-to-length ratio of the third transistor scales proportionally with a width-to-length of the first transistor.

29. A method of configuring a current reference of an integrated circuit, the method comprising:

monitoring a current of a first transistor of the integrated circuit; and selecting a number of fingers of a second transistor to modify the current flowing through the first transistor while the current flowing through the second transistor remains constant even when the number of fingers selected changes;

wherein a gate voltage of the first transistor and the second transistor are the same voltage potential;

wherein a source voltage of the first transistor and the second transistor are the same voltage potential;

wherein a gate-to-source voltage for both the first transistor and the second transistor changes with a selection of a different number of fingers of the second transistor such that the current flowing through the second transistor remains constant and such that the current flowing through the first transistor changes.

30. The method of claim 29, wherein monitoring further comprising aggregating current from a plurality of current reference transistors of the integrated circuit for monitoring of current.

31. The method of claim 29, wherein selecting further comprising permanently selecting the number of fingers for the integrated circuit.

32. The method of claim 29, further comprising:

trimming a resistor of a resistor ladder, wherein the resistor ladder provides one or more voltage references, wherein a current flowing through the resistor ladder from a third transistor partially determines the voltage of the voltage references; and selecting a number of fingers for the third transistor such that a width-to-length ratio of the third transistor scales proportionally with a width-to-length ratio of the first transistor.

* * * * *